United States Patent [19]

Rivera

[11] Patent Number: 5,012,536

[45] Date of Patent: May 7, 1991

[54] ECONOMIC SHOWER

[76] Inventor: Antolin Rivera, HC 71 Box 2031, Naranjito

[21] Appl. No.: 401,934

[22] Filed: Sep. 1, 1989

[51] Int. Cl.[5] ..... A47K 3/22

[52] U.S. Cl. ..... 4/605; 4/617

[58] Field of Search ..... 4/597, 602, 605, 615, 4/616, 617, 192, 194, 603, 596, 601, 598, 606, 600, 610, 612, 614; 116/227, 276; 137/558, 577

[56] References Cited

U.S. PATENT DOCUMENTS

| | | | |
|---|---|---|---|
| 133,702 | 12/1872 | Foote | 4/602 |
| 2,052,420 | 8/1936 | Peterson | 4/617 |
| 2,492,913 | 12/1949 | Bailey | 4/598 |
| 2,567,506 | 9/1951 | Bowman | 4/603 |
| 3,471,872 | 10/1969 | Symmons | 4/191 |

FOREIGN PATENT DOCUMENTS

| | | | |
|---|---|---|---|
| 150726 | 4/1926 | Australia | 4/606 |
| 194203 | 1/1908 | Fed. Rep. of Germany | 4/617 |
| 613580 | 11/1926 | France | 4/602 |
| 411761 | 6/1945 | Italy | 4/616 |

*Primary Examiner*—Henry J. Recla
*Assistant Examiner*—David J. Walczak
*Attorney, Agent, or Firm*—Richard L. Miller

[57] ABSTRACT

This economic shower is designed to store and mix water at a desired temperature for use. Primarily, it consists of a reservoir water tank mounted to a wall, and an input pipe is coupled to the tank and to existing hot and cold water control valves. An output pipe is secured to the bottom of the tank and has a shower head attached, and a flexible hose with a valve controlled massage shower head is also attached to the output pipe.

3 Claims, 1 Drawing Sheet

ECONOMIC SHOWER

BACKGROUND OF THE INVENTION

The instant invention relates generally to shower devices, and more particularly, to an economic shower.

Numerous shower devices have been provided in the prior art that are adapted to provide economic showering. For example, U.S. Pat. Nos. 1,844,038 to Hooker; 3,080,568 to Burnett and 3,471,872 to Symmons all are illustrative of such prior art. While these units may be suitable for the particular purpose to which they address, they would not be as suitable for the purpose of the present invention as hereafter described.

SUMMARY OF THE INVENTION

A primary object of the present invention is to provide an economic shower that will overcome the shortcomings of the prior art devices.

Another object is to provide an economic shower that will be of such design, as to include an overhead reservoir tank for water at a desired temperature.

An additional object is to provide an economic shower that will be coupled to a hot and cold water source, and the output will be coupled to a pipe and shower head.

A still further object is if there is a sudden disproportionate drop in either hot or cold water pressure, for example from the unexpected use of either an automatic hot water using appliance or flushing a toilet respectively, the change in water temperature to the user of the instant invention will be minimized thus preventing an accidental burn or chilling situation.

A yet another object is if there is a total loss of water pressure a short emergency shower can still be had using the reserve water previously stored in the reservoir tank; and A still additional object is if the user so desires a scented bath oil can be added to the reservoir through a vent cap before the tank is completely filled with water.

A further object is to provide an economic shower that is simple and easy to use.

A still further object is to provide an economic shower that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
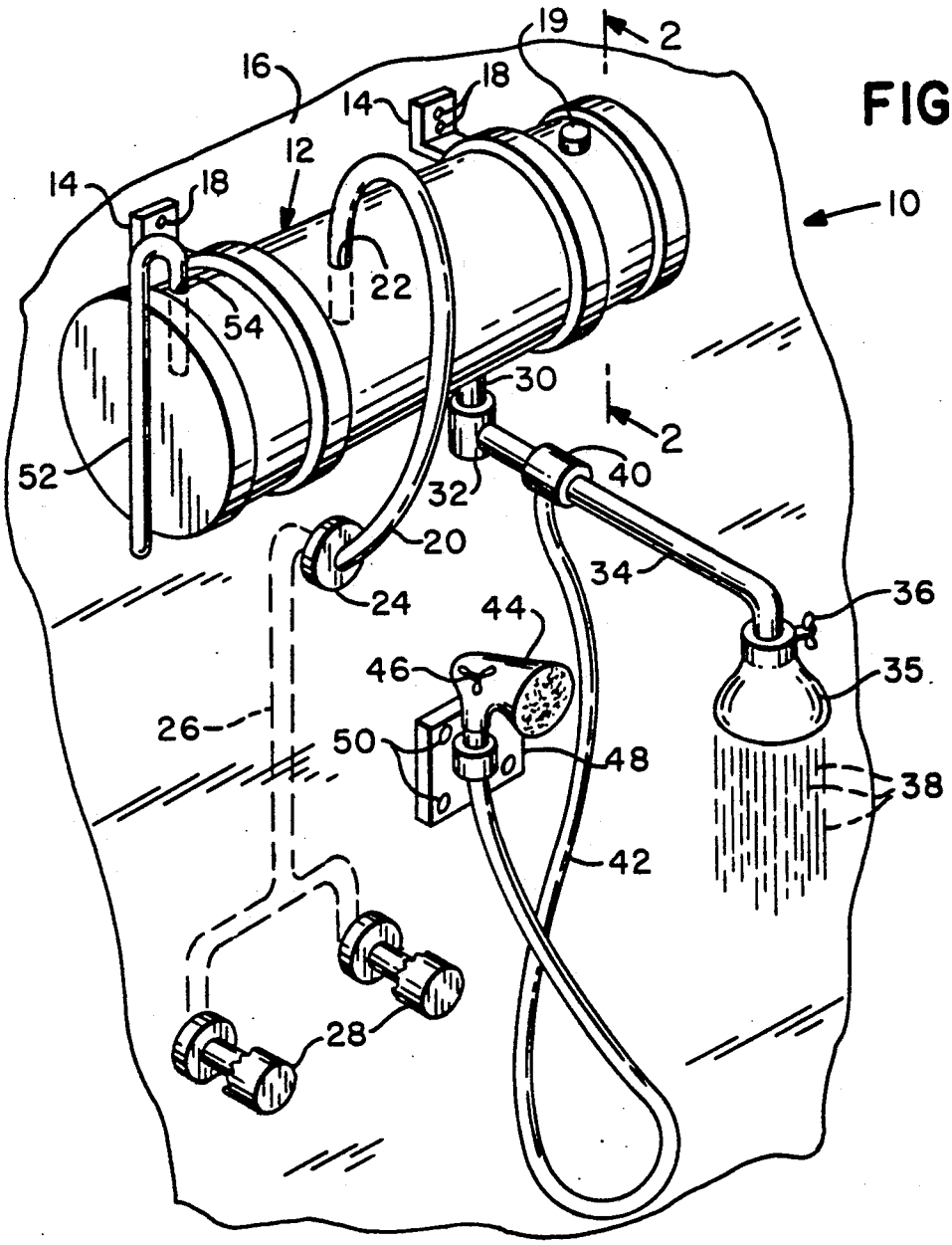
FIG. 1 is a diagrammatic perspective view of the instant invention.
Figure 2:
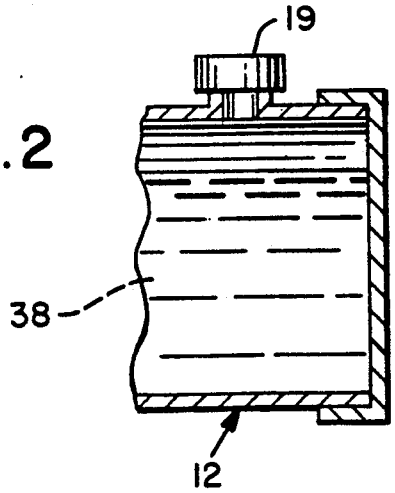
FIG. 2 is an enlarged fragmentary cross sectional view taken on line 2—2 of FIG. 1.

Turning now descriptively to the drawings, in which like reference characters denote like elements throughout the several views, a shower unit 10 is shown to include a buffer reservoir tank 12 which is received in a pair of support straps 14 that are fastened to wall 16 by fasteners 18, and a combination clean out and vent cap 19 is provided on tank 12. An input line 20 is provided and one end is received in an opening 22 provided in the top of tank 12. The other end of input line 20 is secured to a fitting 24 in wall 16, and a mixer pipe 26 is coupled to fitting 24 and is coupled to a pair of control valves 28 extending from wall 16. Valves 28 are mounted in the hot and cold water sources (not shown) behind wall 16.

An output pipe 30 is fixedly secured to the bottom of tank 12 and is received in a fitting 32 that is coupled to an overhead shower outlet pipe 34 coupled to a shower head 35 having an adjustment valve screw 36. Shower head 35 is designed to dispense the mixed hot and cold water 38 that has been stored within the buffer reservoir tank 12.

A T-fitting 40 in pipe 34 is coupled to one end of a flexible hose 42 that is coupled to a water massage shower head 44 having a control valve 46. Head 44 is mounted releasably clipped to a mounting plate 48 in a suitable manner (not shown). Such a mounting clip may be magnetic or otherwise as is well known in the art, and plate 48 is secured to wall 16 by fasteners 50.

A water overflow pipe 52 is provided with a first end fixedly secured in an opening 54 in the top portion of the tank 12 and a second end extending downwardly. When the tank is completely filled, the overflow will indicate to the user to shut off control valves 28. The water is tested during the process of filling the tank 12 by opening the valve screw 36.

In use, the control valves 28 are turned on causing hot and cold water to flow upward through input pipe 20 which fills reservior tank 12. As such occurs, the valve screw 36 must be in the full off position to prevent flow of water 38 from the shower head 35. The valve 46 must also be in the off position on the massage shower head 44.

When desired, the massage shower head 44 is used by first turning off the shower head 35.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A shower unit for use in a building provided with hot and cold water sources;

a shower unit, comprising, (a) a buffer reservoir tank, for storage of mixed hot and cold water travelling under pressure from the hot and cold water sources of the building;

(b) mounting straps on said buffer reservoir tank adapted to be secured by fasteners to a wall of said building;

(c) an input pipe having one end received and secured in said buffer reservoir tank, for transmitting mixed hot and cold water from the building water sources;

(d) a mixer pipe having one end coupled to the other end of said input pipe and an opposite end adapted to be coupled to hot and cold water control valves of the building water sources;

(e) a water overflow pipe secured to a top portion of one end of said buffer reservoir tank and depending downwardly from said reservoir tank, for indicating to the user that said buffer reservoir is full; and (f) an output pipe having one end secured to a lower portion of said buffer reservoir tank, for gravity feed of mixed water from said buffer reservoir tank and a shower head secured to an opposite end of said output pipe and having shut-off valve means whereby the buffer reservoir tank will store sufficient water from the hot and cold water sources of the building at a desired temperature so as to act as a buffer, preventing sudden temperature variations in the water fed to the shower head in the event of sudden changes in relative water pressures of the hot and cold water sources of the building.

2. A shower unit as set forth in claim 1, wherein a removable vent cap received on a neck of said buffer reservoir tank for air escape means when water is entering said buffer reservoir tank, said neck also providing auxiliary water and chemical input means in an event that the building water sources are shut off.

3. A shower unit as set forth in claim 2, wherein said output pipe is fixedly secured to a bottom of said reservior tank and is coupled to said shower head, a second shower head for massage, is removably secured to a mounting plate fastened to said wall and a flexible hose coupled between said output pipe and said second shower head.

* * * * *